US010116066B2

(12) United States Patent
Schaepperle

(10) Patent No.: US 10,116,066 B2
(45) Date of Patent: Oct. 30, 2018

(54) ANTENNA ARRAY FOR TRANSMITTING AND/OR FOR RECEIVING RADIO FREQUENCY SIGNALS, ACCESS NETWORK NODE AND VEHICLE THEREOF

(71) Applicant: Alcatel Lucent, Boulogne Billancourt (FR)

(72) Inventor: Joerg Schaepperle, Stuttgart (DE)

(73) Assignee: Alcatel Lucent, Boulogne Billancourt (FR)

( * ) Notice: Subject to any disclaimer, the term of this patent is extended or adjusted under 35 U.S.C. 154(b) by 428 days.

(21) Appl. No.: 14/781,826

(22) PCT Filed: Feb. 14, 2014

(86) PCT No.: PCT/EP2014/052917
§ 371 (c)(1),
(2) Date: Oct. 1, 2015

(87) PCT Pub. No.: WO2014/161688
PCT Pub. Date: Oct. 9, 2014

(65) Prior Publication Data

US 2016/0064829 A1 Mar. 3, 2016

(30) Foreign Application Priority Data

Apr. 3, 2013 (EP) ..... 13305428

(51) Int. Cl.
*H01Q 21/24* (2006.01)
*H01Q 1/32* (2006.01)
(Continued)

(52) U.S. Cl.
CPC ..... *H01Q 21/24* (2013.01); *H01Q 1/32* (2013.01); *H01Q 9/0435* (2013.01);
(Continued)

(58) Field of Classification Search
CPC .. H01Q 21/0025; H01Q 21/06; H01Q 21/061; H01Q 21/065; H01Q 21/205;
(Continued)

(56) References Cited

U.S. PATENT DOCUMENTS

2002/0122008 A1* 9/2002 Caimi ..... H01Q 1/246 343/742
2002/0175862 A1* 11/2002 Hunter ..... H01Q 21/24 343/700 MS
(Continued)

FOREIGN PATENT DOCUMENTS

CN 102751592 A 10/2012
CN 102570055 B 11/2013
(Continued)

OTHER PUBLICATIONS

Written Opinion of the International Searching Authority for PCT/EP2014/052917.*
(Continued)

*Primary Examiner* — Dameon E Levi
*Assistant Examiner* — Jennifer F Hu
(74) *Attorney, Agent, or Firm* — Fay Sharpe LLP

(57) ABSTRACT

The embodiments of the invention relate to antenna array (AA1) for transmitting and/or for receiving radio frequency signals. The antenna array (AA1) contains a first antenna element (AE1) and a second antenna element (AE2*a*) forming a first basic arrangement (BA1). The first antenna element (AE1) has a first substantially flat form and is adapted to excite within a first excitation area (EA1) a first electromagnetic field with a first polarization direction (PD1) and a second electromagnetic field with a second polarization direction (PD2) different to the first polarization direction (PD1). The second antenna element (AE2*a*) also has a second substantially flat form. The second antenna
(Continued)

element (AE2*a*) is arranged adjacent to the first antenna element (AE1) and is adapted to excite at least a third electromagnetic field with a third polarization direction (PD3) non-parallel to the first polarization direction (PD1) and non-parallel to the second polarization direction (PD2) within a second excitation area (EA2) arranged non-parallel to the first excitation area (EA1) and facing towards the first excitation area (EA1). The embodiments further relate to an access network node, which contains the antenna array and to a vehicle, which contains the access network node.

12 Claims, 7 Drawing Sheets

(51) Int. Cl.
*H01Q 25/00* (2006.01)
*H01Q 21/06* (2006.01)
*H01Q 9/04* (2006.01)
*H01Q 1/00* (2006.01)

(52) U.S. Cl.
CPC ..... *H01Q 21/065* (2013.01); *H01Q 25/001* (2013.01); *H01Q 1/007* (2013.01)

(58) Field of Classification Search
CPC ..... H01Q 21/24; H01Q 21/26; H01Q 21/293; H01Q 21/296; H01Q 9/0428; H01Q 5/40; H01Q 5/42; H01Q 1/32
See application file for complete search history.

(56) References Cited

U.S. PATENT DOCUMENTS

2004/0095282 A1 5/2004 Fukushima et al.
2004/0140942 A1* 7/2004 Gottl ..... H01Q 13/10 343/810
2005/0242959 A1* 11/2005 Watanabe ..... G06K 19/07749 340/572.7
2006/0214853 A1 9/2006 Hori
2008/0122610 A1* 5/2008 Muirhead ..... B65D 19/0016 340/505
2009/0309788 A1* 12/2009 Welsh ..... G01S 3/14 342/357.31
2010/0328173 A1* 12/2010 Rao ..... H01Q 1/242 343/742
2013/0044028 A1* 2/2013 Lea ..... H01Q 21/24 342/359
2013/0257680 A1* 10/2013 Nix ..... H01Q 1/007 343/876

FOREIGN PATENT DOCUMENTS

JP 2007-027902 A 2/2007
JP 2011-010081 A 1/2011

OTHER PUBLICATIONS

International Search Report for PCT/EP2014/052917 dated Apr. 2, 2014.

* cited by examiner b)

a)

ANTENNA ARRAY FOR TRANSMITTING AND/OR FOR RECEIVING RADIO FREQUENCY SIGNALS, ACCESS NETWORK NODE AND VEHICLE THEREOF

FIELD OF THE INVENTION

Embodiments of the invention relate to a transmission and/or a reception of radio frequency signals by an antenna array and, more particularly but not exclusively, to a transmission and/or reception of radio frequency signals having polarization portions in three linearly independent spatial directions.

BACKGROUND

A capacity of a radio link between a transmitter and a receiver can be increased by applying a so-called MIMO-, SIMO- or MISO transmission (MIMO=Multiple Input Multiple Output, SIMO=Single Input Multiple Output, MISO=Multiple Input Single Output). Single input means, that only one antenna element is applied for transmitting radio frequency signals from the transmitter. Multiple input means, that two or more antenna elements form a transmit antenna array for transmitting the radio frequency signals from the transmitter. Single output means, that one antenna element is applied for receiving the radio frequency signals at the receiver. Multiple output means, that two or more antenna elements form a receive antenna array for receiving the radio frequency signals at the receiver.

Radio frequency signals are usually linearly polarized and a polarization direction corresponds to an electrical field vector of the radio frequency signals. The electrical field vector is always orthogonally aligned to a propagation direction of the radio frequency signals. The transmit antenna array and the receive antenna array are usually not aligned to each other, especially when the transmitter and/or the receiver are movable. Furthermore, a transmission path of the radio frequency signals from the transmit antenna array to the receive antenna array is not always identical to a shortest route between the transmit antenna array to the receive antenna array due to reflections and scattering. Therefore, the polarization direction of the received radio frequency signals may not correspond optimally and may not be parallel aligned to polarization directions of excitation areas of antenna elements of the receive antenna array.

SUMMARY

Polarization directions of radio frequency signals transmitted via multipath channels are impacting an overall data throughput of wireless transmission systems. Thus, objects of the embodiments of the invention are increasing the overall data throughput of the wireless transmission systems.

The object is achieved by an antenna array for transmitting radio frequency signals and/or for receiving radio frequency signals. The antenna array contains a first antenna element and a second antenna element, which both form a first basic arrangement. The first antenna element has a first substantially flat form and is adapted to excite within a first excitation area a first electromagnetic field with a first polarization direction and a second electromagnetic field with a second polarization direction different to the first polarization direction. The second antenna element also has a second substantially flat form. The second antenna element is arranged adjacent to the first antenna element and is adapted to excite at least a third electromagnetic field with a third polarization direction non-parallel to the first polarization direction and non-parallel to the second polarization direction within a second excitation area arranged non-parallel to the first excitation area and facing towards the first excitation area.

Preferably, the first antenna element is a first patch antenna with for example a quadratic, octagonal, circular, elliptical or a hexagonal patch containing a metal material such as copper and the second antenna element is a second patch antenna with preferably a same form and a same material. Alternatively, the first antenna element may be formed by two non-parallel intersected antenna rods and the second antenna element may be formed by one further antenna rod or by two further non-parallel intersected antenna rods. In further alternatives, micro-strip antennas such as a rectangular micro-strip patch antenna or a so-called Planar Inverted F Antenna (PIFA) may be applied for the first antenna element and the second antenna element.

The embodiments of the invention provide a first benefit of increasing an overall data throughput of wireless transmission systems because radio frequency signals may be transmitted with multiple radiation beams having together up to three orthogonal polarizations on a same radio resource (e.g. same time slot and/or same frequency subcarrier and/or same spreading code).

The embodiments of the invention provide a second benefit of providing an antenna array, which allows receiving linear polarized radio frequency signals whatever polarization direction is used at the transmitter and whatever alteration of the polarization direction has occurred on the transmission path from the transmit antenna array to the receive antenna array.

The embodiments of the invention provide a third benefit of allowing manufacturing the antenna array in an easy way. During a manufacturing process of the antenna array based on patch antennas flat ground plates of the antenna elements can be connected at corresponding edges of the ground plates and flat elements containing the excitation areas may be produced by a standard process for printed circuit boards. Due to a basically flat structure of the antenna array, feeder cables can be easily aligned with respect to the antenna elements and the feeder cables can be easily connected to the antenna elements.

The embodiments of the invention offer further benefits, when mutually orthogonal patch antennas are arranged in the proposed way instead of using parallel patch antennas on a completely flat surface. An emission characteristic of the antenna array is improved in that way, that in a larger field of a solid angle a direction of beam is approximately orthogonal on at least a subset of antenna elements of the antenna array or at least an angle between normal directions of the antenna elements of the subset and the direction of beam is relatively small. In comparison to an antenna array based on intersected dipoles or intersected antenna rods, an antenna array containing several patches antennas only emits radio frequency signals in a half-space and therefore does not require a reflecting surface for the radio frequency signals.

According to a preferred embodiment, the second antenna element may be further adapted to excite a fourth electrical field with a fourth polarization direction, which is different to the at least third polarization direction. Thereby, the first antenna element and the second antenna element are both capable of transmitting and/or receiving the radio frequency signals with two different polarization directions.

According to a further preferred embodiment, the first excitation area is orthogonal arranged to the second excitation area. The preferred embodiment allows transmitting and receiving radio frequency signals, which may have all three possible orthogonal polarization directions, with a same strength or intensity.

In an even further preferred embodiment, the first polarization direction, the second polarization direction and the third polarization direction are arranged orthogonal to each other. The even further preferred embodiment also allows transmitting and receiving radio frequency signals, which may have all three possible orthogonal polarization directions, with a same strength or intensity.

According to a first alternative embodiment, the antenna array may further contain at least one first further of the first basic arrangement and the at least first further of the first basic arrangement is arranged adjacent to the first basic arrangement along an axis given by an intersection line of a first plane spanned by the first excitation area and of a second plane spanned by the second excitation area. Thereby, the first basic arrangement of the first antenna element and the second antenna element is extended in a first dimension for building antenna arrays with a number of 2×n antenna elements (×: multiplication sign, n: e.g. number of antenna elements in a row).

According to a second alternative embodiment, the antenna array further contains at least one second further of the first basic arrangement and the at least second further of the first basic arrangement is arranged adjacent to the first basic arrangement substantially along an axis, which is given by a further intersection line crossing centrally the first excitation area of the first antenna element and the second excitation area of the second antenna element. Thereby, the first basic arrangement of the first antenna element and the second antenna element is extended in a second dimension for building antenna arrays with a number of m×1 antenna elements (m: e.g. number of antenna elements in a column).

Preferably, the at least second further of the first basic arrangement and the first basic arrangement form a multiple folded area of excitation areas of antenna elements. From a side view, this multiple folded area looks like a zigzag pattern.

In a further preferred embodiment, the first alternative embodiment and the second alternative embodiment may be combined for extending the first basic arrangement in two dimensions for building compact three dimensional antenna arrays with a number of m×n antenna elements.

In a third alternative embodiment, the antenna array further contains a third antenna element. The first basic arrangement and the third antenna element are arranged to a second basic arrangement. The third antenna element has a third substantially flat form and is arranged adjacent to the first antenna element and is arranged adjacent to the second antenna element. The third antenna element is adapted to excite at least a fifth electromagnetic field with a fifth polarization direction within a third excitation area arranged non-parallel to the first excitation area and non-parallel to the second excitation area and facing towards the first excitation area and facing towards the second excitation area. Thereby, the antenna array is able to transmit the radio frequency signals to and to receive the radio frequency signals from arbitrary directions with arbitrary polarization directions in a half-space.

Preferably, the first excitation area, the second excitation area and the third excitation area are arranged orthogonally to each other. Thereby, the antenna array is able to transmit the radio frequency signals to and/or to receive the radio frequency signals from arbitrary directions with arbitrary polarization directions in a half-space with nearly a same quality.

In a fourth alternative embodiment as an extension of the third alternative embodiment, the antenna array further contains at least one further of the second basic arrangement and the at least further of the second basic arrangement is arranged adjacent to the second basic arrangement. Thereby, the second basic arrangement of the first antenna element, the second antenna element and the third antenna element is extended in three dimensions for building antenna arrays with a number of m×n×o antenna elements (o: number of antenna elements with respect to a third dimension).

Preferably, the antenna elements of the antenna array of the fourth alternative embodiment are arranged substantially in triangular, rhombohedral or hexagonal form. Such forms may be given, when a an overall excitation area of the antenna elements of the antenna array provides a plane in a three-dimensional space and when the antenna array is viewed from a normal with respect to the plane within the three-dimensional space.

In further alternative embodiments central points of excitation areas of the antenna elements are arranged in a plane or form a concave or convex surface or form a lateral surface of a cylinder.

Further advantageous features of the embodiments of the invention are defined and are described in the following detailed description.

BRIEF DESCRIPTION OF THE FIGURES

The embodiments of the invention will become apparent in the following detailed description and will be illustrated by accompanying figures given by way of non-limiting illustrations.

DESCRIPTION OF THE EMBODIMENTS

Figure 1:
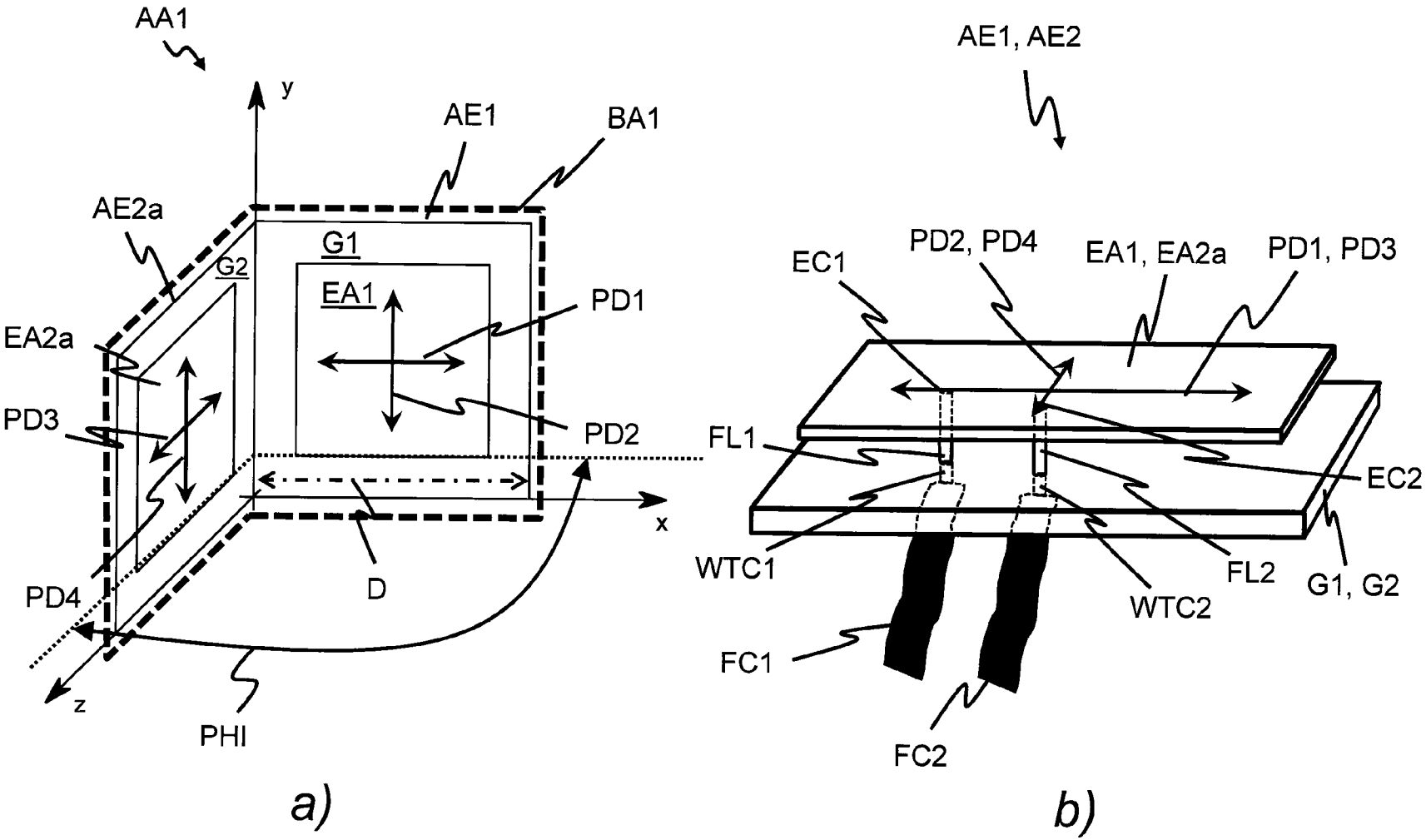
FIG. 1 shows schematically in a perspective view a first basic arrangement of an antenna array containing two antenna elements and a further perspective view of one of the antenna elements of the antenna array according to a first embodiment of the invention.

FIG. 1 *a*) shows an antenna array AA1, which contains in a first basic arrangement BA1 a first antenna element AE1 and a second antenna element AE2*a*. The first antenna element AE1 contains a first quadratic excitation area EA1 for electrical fields in an x-y-plane of a Cartesian coordinate system. The first antenna element AE1 is adapted to excite within the first excitation area EA1 a first electromagnetic field with a first polarization direction PD1 in x direction and thereby the first electromagnetic field is emitted from opposite edges of first excitation area EA1. The first antenna element AE1 is further adapted to excite with the first excitation area EA1 a second electromagnetic field with a second polarization direction PD2 in y direction and thereby the second electromagnetic field is emitted from further remaining opposite edges of first excitation area EA1. This means with respect to the embodiment shown in FIG. 1 *a*) that the first polarization direction PD1 is orthogonal to the second polarization direction PD2. In an alternative, an angle between both polarization directions PD1, PD2 may be in a range between 45 and 135 angular degrees such as 85 angular degrees depending on a geometrical form of the excitation area, which may have alternatively an octagonal, a circular, an elliptical or a hexagonal form.

In a similar way, the second antenna element AE2*a* contains a second quadratic excitation area EA2*a* for electrical fields in a y-z plane of the Cartesian coordinate system. The second antenna element AE2*a* is adapted to excite within the second excitation area EA2*a* a third electromagnetic field with a third polarization direction PD3 in z direction and thereby the third electromagnetic field is emitted from opposite edges of second excitation area EA2. The second antenna element AE2*a* is further adapted to excite within the second excitation area EA2*a* a fourth electromagnetic field with a fourth polarization direction PD4 in y direction and thereby the fourth electromagnetic field is emitted from further remaining opposite edges of second excitation area EA2. This means with respect to the embodiment shown in FIG. 1 *a*) that the third polarization direction PD3 is orthogonal to the fourth polarization direction PD4, the third polarization direction PD3 is also orthogonal to the first polarization direction PD1 and the second polarization direction PD2 and the fourth polarization direction PD4 is parallel to the second polarization direction PD2. Such an arrangement with the first polarization direction PD1, the second polarization direction PD2 and the third polarization direction PD3 being orthogonal to each other is a preferred embodiment.

In an alternative, the third polarization direction PD3 and the fourth polarization direction PD4 are not parallel to the y, z directions, but also have a right angle in between. In a further alternative, an angle between both polarization directions PD3, PD4 may be in a range between 45 and 135 angular degrees such as 85 angular degrees. In an even further alternative, an angle PHI between the first excitation area EA1 and the second excitation area EA2*a* measured from a front side of the excitation areas EA1, EA2 may be instead of 90 angular degrees preferably in a range between 80 and 135 angular degrees such as 100 angular degrees or 120 angular degrees.

The first antenna element AE1 and the second antenna element AE2*a* may be for example so-called well known patch antennas as shown in FIG. 1 *a*) and as shown in more detail with respect to FIG. 1 *b*). A patch antenna contains a conductive ground plate G1, G2 such as a quadratic ground plate, a conductive patch with a quadratic form (see FIG. 1 *a*) and *b*)) or a hexagonal form providing the excitation area EA1, EA2*a*, a first feeder link FL1 for a first electrical contact EC1 of the conductive patch and a second feeder link FL2 for a second electrical contact EC2 of the conductive patch. A distance between the conductive patches of the first antenna element AE1 and the second antenna element AE2*a* may be for example equal to or in range of a half wavelength of the electromagnetic field.

The first antenna element AE1 and the second antenna element AE2*a* are located close and adjacent to each other. The conductive ground plates G1, G2 are in contact as shown in FIG. 1 *a*). Alternatively, the conductive ground plates may be separated from each other.

Typically, the antenna elements AE1, AE2 are controlled each with respect to a so-called 50 ohm point, when 50 ohm lines are applied, which is usual for antenna elements. Positions of the electrical contacts EC1, EC2 define impedance levels and polarization directions. The position of the first electrical contact EC1 may be determined for example by field simulations. Such a determination is well-known to persons skilled in the art and is therefore not described in more detail.

The first electrical contact EC1 may be applied for exciting for example the first electrical field with the first polarization direction PD1 in case of the first antenna element AE1 or the third electrical filed with the third polarization direction PD3 in case of the second antenna element AE2*a*. The second electrical contact EC2 may be applied for exciting for example the second electrical field with second polarization direction PD2 in case of the first antenna element AE1 or the fourth electrical filed with the fourth polarization direction PD4 in case of the second antenna element AE2*a*.

Such an arrangement of the first electrical contact EC1 and the second electrical contact EC2 at the metal plate allows exciting two electrical fields with two orthogonal polarizations, which have either the first and second polarization direction PD1, PD2 in case of the first antenna element AE1 or have the third and fourth polarization direction PD3, PD4 in case of the second antenna element AE2.

An electrical contact between an inner conductor of a first feeder cable FC1 and the first feeder link FL1 may be provided by a first perforation of the ground plate G1, G2 and a first wire through connection WTC1 within the first perforation from the first feeder cable FC1 to the first feeder link FL1. An electrical contact between an inner conductor of a second feeder cable FC2 and the second feeder link FL2 may be provided by a second perforation of the ground plate G1, G2 and a second wire through connection WTC2 within the second perforation from the second feeder cable FC2 to the second feeder link FL2.

The ground plate G1, G2 may be contacted to an outer conductor of the first feeder cable FC1 and/or an outer conductor of the second feeder cable FC2. Preferably, the first wire through connection WTC1 and the first feeder link FL1 may be provided by a first continuous wire and the second wire through connection WTC2 and the second feeder link FL2 may be provided by a second continuous wire. The first feeder cable FC1 and the second feeder cable FC may be for example coaxial cables.

Alternatively instead of applying patch antennas, the at least first antenna element AE1 may be formed by two non-parallel intersected antenna rods with a dipole distance between the two antenna rods that is large enough distance for an electrical isolation and radio frequency decoupling and that is small in comparison to half a wavelength of the electromagnetic field and the at least second antenna element AE2*a* may be formed by one further antenna rod or by two further non-parallel intersected antenna rods also with the dipole distance in between. In further alternatives, micro-strip antennas such as a rectangular micro-strip patch antenna or a so-called Planar Inverted F Antenna (PIFA) may be applied for the at least first antenna element and the at least second antenna element. In principle all kind of antenna elements, which are able to excite two electrical fields with up to two different polarization directions and which have a substantially flat spatial form, can be applied for the present invention. Substantially flat spatial form means that a single antenna element is only able to emit radio frequency signals into a half-space or to receive radio frequency signals from the half-space, which is confined by the excitation area of the antenna element.

The first excitation area EA1 of the first antenna element AE1 as shown in FIG. 1 *a*) has a normal vector $e_z$ and the second excitation area EA2*a* of the second antenna element AE2*a* has a normal vector $e_x$. Centers of the antenna elements AE1, AE2*a* are at positions $r_1$, $r_2$ given by following equations:

$$r_1 = \frac{D}{2}\begin{pmatrix}1\\1\\0\end{pmatrix},\quad r_2 = \frac{D}{2}\begin{pmatrix}0\\1\\1\end{pmatrix}, \tag{1}$$

where D is a lateral dimension of the antenna element AE1, AE2*a* and is particularly a length of an edge of the ground plates G1, G2, which is typically in the order of magnitude of the half wavelength λ/2 or higher.

An incoming electromagnetic wave traveling in a propagation direction of wave vector k can be described by following electrical field vector $$E(r,t)=E\exp[-j(\omega t-k\cdot r)] \tag{2}$$

with E·k=0, i.e., the electrical field vector is orthogonal to the wave vector $k=(k_x, k_y, k_z)^T$.

The incoming electromagnetic wave has following electrical field vectors at the centers of the antenna elements AE1, AE2*a*:

$$E_1 = E(r_1, t) = E\exp\left[-j\left(\omega t - \frac{D}{2}(k_x + k_y)\right)\right] \tag{3}$$

$$E_2 = E(r_2, t) = E\exp\left[-j\left(\omega t - \frac{D}{2}(k_y + k_z)\right)\right] \tag{4}$$

where $E_1$, is an electrical field vector at the center of the first antenna element AE1 and $E_2$ is an electrical field vector at the center of the second antenna element AE2.

The first antenna element AE1 receives x and y components $E_{1,x}$, $E_{1,y}$ of the electrical field vector $E_1=E(r_1,t)$ according to following equations: $E_{1,x}=E_1\cdot e_x$, $E_{1,y}=E_1\cdot e_x$.

A received signal $r_{1,x}$ of the x component $E_{1,x}$ may be given by following equation $$r_{1,x}=E_{1,x}f_{1,x}(k), \tag{5}$$

where $f_{1,x}(k)$ is a function of the propagation direction of the incoming electromagnetic wave and depends on an orientation of the first antenna element AE1 and on a polarization direction of the incoming electromagnetic wave and describes a strength of an antenna output signal in dependence of the propagation direction relative to the orientation of the first antenna element AE1.

Accordingly, a received signal $r_{1,y}$ at the first antenna element AE1 of the y component $E_{1,y}$, a received signal $r_{2,y}$ at the second antenna element AE2*a* of a y component $E_{2,y}$ and a received signal $r_{2,z}$ at the second antenna element AE2*a* of a z component $E_{2,z}$ may be given by following equations:

$$r_{1,y}=E(r_1,t)\cdot e_y f_{1,y}(k) \tag{6}$$

$$r_{2,y}=E(r_2,t)\cdot e_y f_{2,y}(k) \tag{7}$$

$$r_{2,z}=E(r_2,t)\cdot e_z f_{2,z}(k) \tag{8}.$$

If the electromagnetic wave travels for example in the wave vector direction $$k = \frac{2\pi}{\lambda}\left(-\frac{1}{\sqrt{2}}, 0, -\frac{1}{\sqrt{2}}\right)^T,$$

the electrical field vectors at the centers of the antenna elements AE1, AE2*a* are given by following equation $$E(r_1, t) = E(r_2, t) = E\exp\left[-j\left(\omega t + \frac{1}{\sqrt{2}}\pi\frac{D}{\lambda}\right)\right], \tag{9}$$

i.e., the two electrical field vectors have same amplitude and same phase. Conversely, if the two antenna elements AE1, AE2*a* are excited with the same phase, a transmitted radio frequency signal has a maximum strength in an opposite propagation direction of a wave vector −k.

Figure 2:
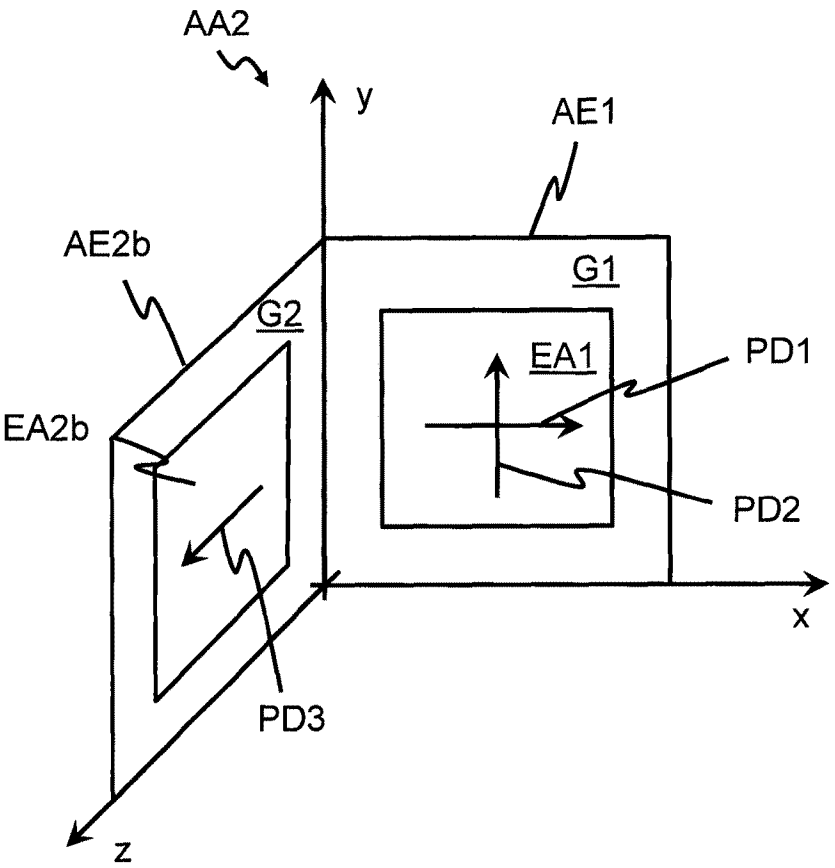
FIG. 2 shows schematically in a perspective view the first basic arrangement of the antenna array containing two antenna elements according to a second embodiment of the invention.

FIG. 2 shows a further antenna array AA2, which contains the first antenna element AE1 and a second antenna element AE2*b*. The only difference between the antenna array AA1 and the antenna array AA2 is a replacement of the second antenna element AE2*a* by a further second antenna element AE2*b*. The further second antenna element AE2*b* of the antenna array AA2 is different to the second antenna element AE2*a* of the antenna array AA1 with regard to an excitation area EA2*b* of the further second antenna element AE2*b*. The excitation area EA2*b* is only adapted to excite the third electrical field with the third polarization direction PD3 in z direction and no further electrical field with another polarization direction. This means, that a fourth polarization direction of the further antenna array AA2, which is in principle redundant when using three orthogonal polarization directions PD1, PD2, PD3 at the first antenna element AE1 and the second antenna element AE2*b*, is not present.

The second antenna element AE2*b* can be easily realized by applying only one of the two electrical contacts EC1, EC2 at the conductive patch as shown in FIG. 1 *b*), when a patch antenna is used for the antenna element AE2*b*. Alternatively, only a single antenna rod is applied as a single dipole for the second antenna element AE2*b*.

Preferably, the first polarization direction PD1 and the second polarization direction PD2 of the first antenna element AE1 and the third polarization direction PD3 of the antenna element AE2*b* are orthogonal to each other. Similar alternatives as described with respect to the embodiment of FIG. 1 *a*) may be applied for non-orthogonal polarization directions.

Figure 3:
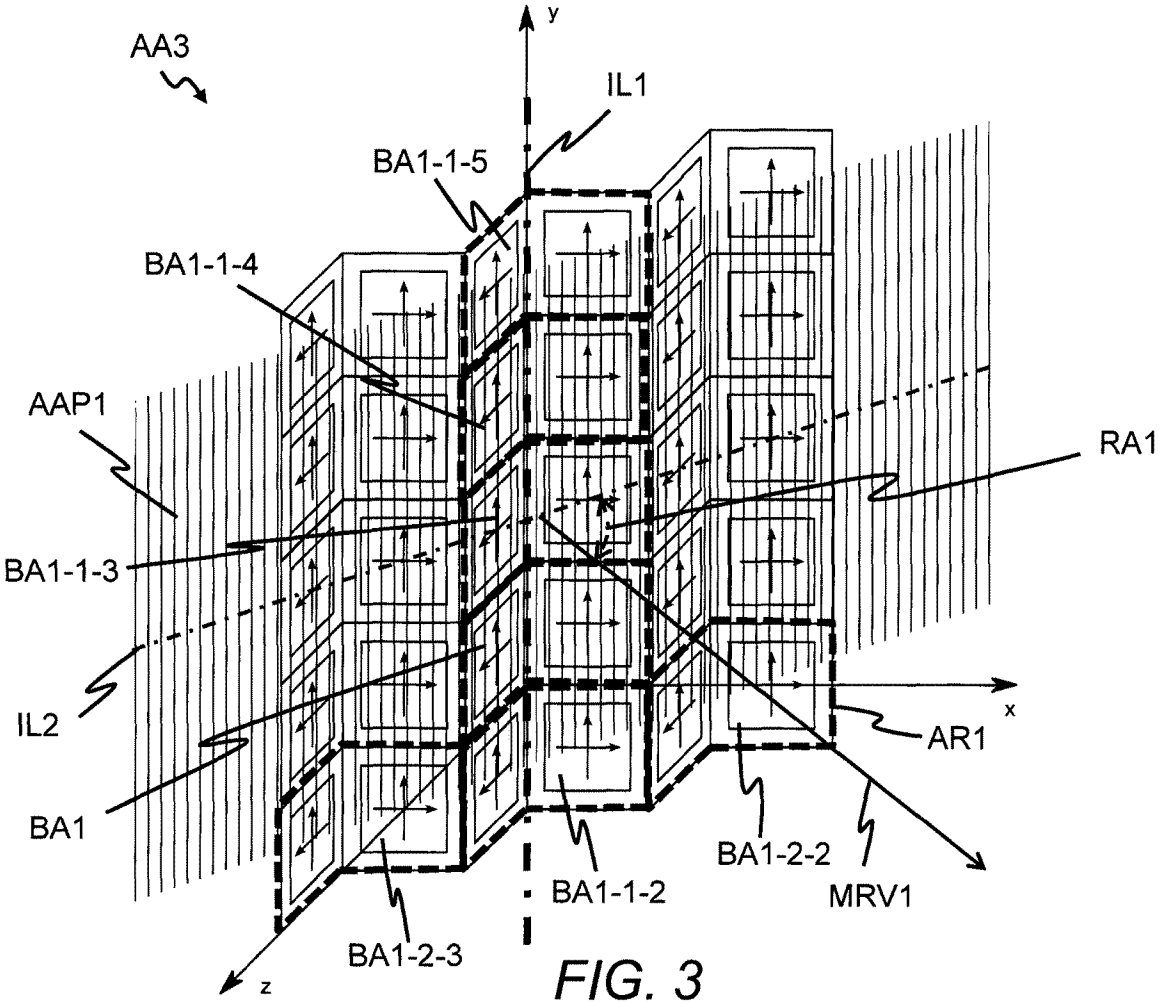
FIG. 3 shows schematically in a perspective view an antenna array based on several first basic arrangements of the antenna array of the first embodiment of the invention.

FIG. 3 shows schematically a 5×6 antenna array AA3 with 5 rows of antenna elements and with 6 columns of antenna elements. The antenna elements within a row and with a column may be adjacent arranged to each other with no gap or with a gap similar to the gap as described with respect to the embodiment of FIG. 1 *a*).

In further alternatives, the antenna array AA3 may have less or more than 5 rows and/or the antenna array AA3 may have less or more than 6 columns such as a 4×4 antenna array, a 6×2 antenna array, a 1×8 antenna array or a 6×6 antenna array.

The antenna array AA3 contains the first basic arrangement BA1 of the first antenna element AE1 and the second antenna element AE2*a* and further contains four further basic arrangements BA1-1-2, BA1-1-3, BA1-1-4, BA1-1-5 adjacent to each other in the y direction of the Cartesian coordinate system. The resulting antenna array is a 5×2 antenna array.

In a more general way, one further first basic arrangement BA1-1-2 or several further first basic arrangements BA1-1-2, BA1-1-3, BA1-1-4, BA1-1-5 may be arranged adjacent to the first basic arrangement BA1 along an axis, which is given by an intersection line IL1 of a first plane spanned by the first excitation area EA1 of the first antenna element AE1 and of a second plane spanned by the second excitation area EA2 of the second antenna element AE2*a*. The resulting antenna array is a n×2 antenna array.

The antenna array AA3 further contains two even further basic arrangements BA1-2-2, BA1-2-3 adjacent to each other in the x direction and the z direction of the Cartesian coordinate system. The resulting antenna array is a 1×6 antenna array.

In a more general way, one even further first basic arrangement BA1-2-1 or several even further first basic arrangements BA1-2-2, BA1-2-3 may be arranged adjacent to the first basic arrangement BA1 along an axis, which is given by a further intersection line IL1, which crosses centrally the first excitation area EA1 of the first antenna element AE1 and the second excitation area EA2 of the second antenna element AE2*a*. The resulting antenna array is a 1×m antenna array.

A size of an offset between two antenna elements in x direction may be given by a size of the antenna elements with a normal in the z direction and a size of an offset between two antenna elements in z direction may be given by a size of the antenna elements with a normal in the x direction.

When combining the n×2 antenna array and the 1×m antenna array to form a n×m antenna array as shown in the FIG. 3 with n=5 and m=6, the multiple adjacent arrangements BA1-1-2, BA1-1-3, BA1-1-4, BA1-1-5, BA1-2-2, BA1-2-3 of the first basic arrangement BA1 form a multiple folded area of excitation areas EA1, EA2*a*, EA3 of antenna elements AE1, AE2*a*, AE3.

In an alternative, the antenna array AA2 may provide the first basic arrangement or building block for the antenna array AA3. All variants and alternatives, which are described with respect to the antenna array AA1 and the antenna array AA2 may be applied for the antenna array AA3.

Antenna elements of the antenna array AA3, which have the normal vector $e_z$ and which are parallel arranged with respect to the x-y plane, may have their centers represented by vectors $r_{1,i,j}$ and antenna elements of the antenna array AA3, which have the normal vector $e_x$ and which are parallel arranged with respect to the y-z plane, may have their centers represented by vectors $r_{2,j,k}$. The vectors $r_{1,i,j}$ and $r_{2,j,k}$ are given by following equations:

$$r_{1,i,j} = \begin{pmatrix} iD + \frac{D}{2} \\ jD + \frac{D}{2} \\ -iD \end{pmatrix}, \quad r_{2,j,k} = \begin{pmatrix} -kD \\ jD + \frac{D}{2} \\ kD + \frac{D}{2} \end{pmatrix}, \tag{10}$$

where i is an integer index with respect to the x direction, j is an integer index with respect to the y direction and k is an integer index with respect to the z direction. This means that centers of all antenna elements of the antenna array AA3 are within an antenna array plane AAP1 (see FIG. 3).

Vectors of the electrical field at the centers of the antenna elements for an electromagnetic wave with the wave vector k may be given by following equations:

$$E(r_{1,i,j}, t) = E \exp\left[-j\left(\omega t - \frac{D}{2}((2i+1)k_x + (2j+1)k_y - 2ik_z)\right)\right] \tag{11}$$

$$E(r_{2,i,j}, t) = E \exp\left[-j\left(\omega t - \frac{D}{2}(-2kk_x + (2j+1)k_y + (2k+1)k_z)\right)\right] \tag{12}$$

where $k_x$, $k_y$, $k_z$ are vector components of the wave vector k and k is the integer index with respect to the z direction.

If inputs of the antenna elements of the antenna array AA3 are fed with radio frequency signals with phases as given in the equations (11) and (12) but inverted sign, the antenna array AA3 transmits a radio frequency signal in the propagation direction of a wave vector $-k=-(k_x,k_y,k_z)^T$. A beam width of the radio frequency signal depends on a number of antenna elements used at the antenna array AA3 and depends on a distance to the antenna array AA3.

If an incoming electromagnetic wave propagates with a wave vector direction $$k = \frac{2\pi}{\lambda}\left(-\frac{1}{\sqrt{2}}, 0, -\frac{1}{\sqrt{2}}\right)^T,$$

which is orthogonal to the antenna array plane AAP1 containing the centers or central points of excitation areas of the antenna elements of the antenna array AA3, the electrical field vectors may be represented by following equations:

$$E(r_{1i,j}, t) = E \exp\left[-j\left(\omega t + \frac{\pi D}{\sqrt{2}\lambda}\right)\right] \tag{13}$$

$$E(r_{2,j,k}, t) = E \exp\left[-j\left(\omega t + \frac{\pi D}{\sqrt{2}\lambda}\right)\right]. \tag{14}$$

Equations (13) and (14) show, that phases of the electrical field vectors are independent of the indices i, j, k, i.e., the electromagnetic field vectors at the centers of the excitation areas of all antenna elements of the antenna array AA3 all have the same phase. Conversely, if all excitation areas of the antenna elements of the antenna array AA3 may be excited with the same phase, the antenna array AA3 transmits a radio frequency signal with a maximum amplitude in the opposite wave vector direction, which is shown in FIG. 3 by a maximum radiation vector MRV1, which is orthogonal with a radiation angle RA1 of 90° to the antenna array plane AAP1. This is a so-called center direction of the antenna array AA3.

The antenna array AA3 is capable of forming beams in three dimensions of a half-space, which is confined by the antenna array plane AAP1 and which uses all three orthogonal polarization directions PD1, PD2, PD3. It is most suited for environments where there is a high angular spread in a plane parallel to the x-z plane but where there is a low angular spread perpendicular to the x-z plane.

Instead of having all centers of the excitation areas of the antenna elements of the antenna array AA3 in a single antenna array plane as shown in FIG. 3, in further alternatives the centers or central points of the excitation areas of the antenna elements of the antenna array AA3 may form a concave or convex surface or may form a lateral surface of a cylinder.

Figure 4:
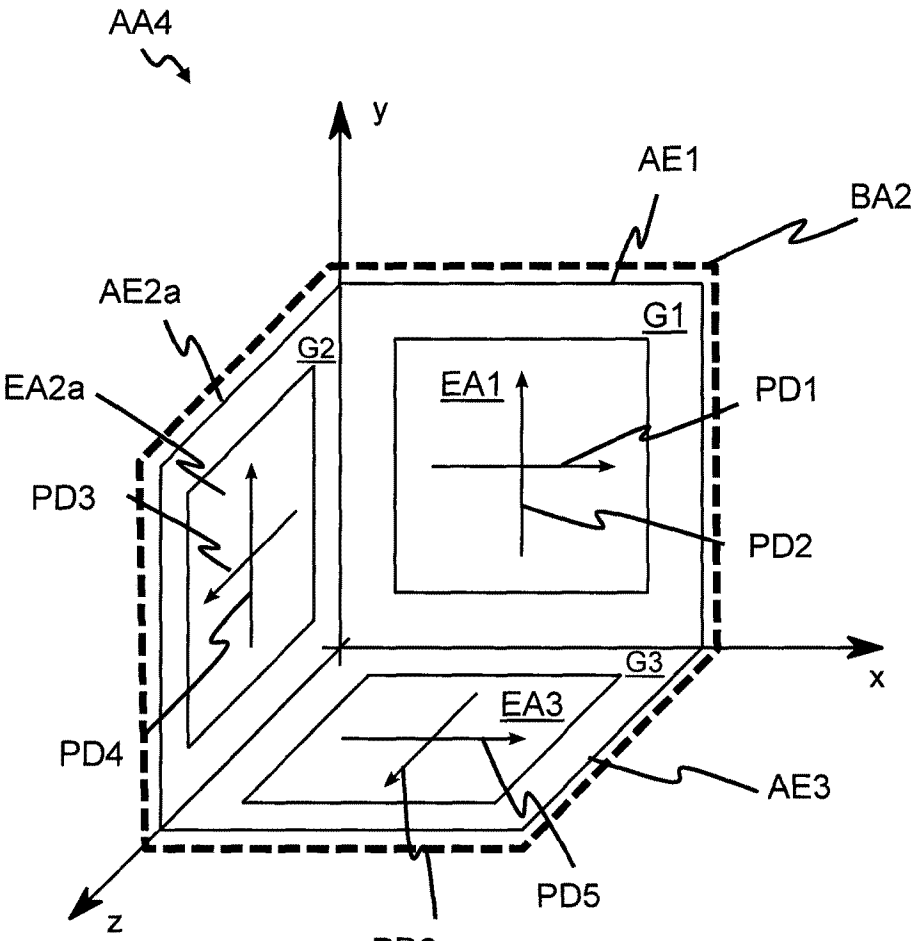
FIG. 4 shows schematically in a perspective view a second basic arrangement of an antenna array according to a fourth embodiment of the invention.

FIG. 4 shows a further antenna array AA4, which contains the first antenna element AE1 of the antenna array AA1 and the second antenna element AE2*a* of the first basic arrangement BA1 of the antenna array AA1 and which contains a third antenna element AE3. The first basic arrangement BA1 and the third antenna element AE3 form a second basic arrangement BA2.

The third antenna element AE3 also has a substantially flat form to be able to emit radio frequency signals into or to receive radio frequency signals from a half-space, which is confined by a third excitation area EA3 of the third antenna element AE3.

The third antenna element AE3 is located in the x-z-plane of the Cartesian coordinate system and is arranged adjacent to the first antenna element AE1 and is arranged adjacent to the second antenna element AE2. This means, the third antenna element AE3 contains the third excitation area EA3 for electrical fields in the x-z plane of the Cartesian coordinate system. Thereby, the third excitation area EA3 is arranged non-parallel to the first excitation area EA1 and non-parallel to the second excitation area EA2 and the third excitation area EA3 faces towards the first excitation area EA1 and the second excitation area EA2*a* similar as the second excitation area EA2*a* faces towards the first excitation area EA1 in FIG. 1 *a*).

Preferably, the third antenna element AE3 is adapted to excite within the third excitation area EA3 a fifth electromagnetic field with a fifth polarization direction PD5 in x direction and is adapted to excite with the third excitation area EA3 a sixth electromagnetic field with a sixth polarization direction PD6 in z direction. This means, an angular degree between the fifth polarization direction PD5 and the sixth polarization direction PD6 is also 90 angular degrees and the fifth polarization direction PD5 of the third antenna element AE3 is parallel to the first polarization direction PD1 of the first antenna element AE1 and the sixth polarization direction PD6 of the third antenna element AE3 is parallel to the third polarization direction PD3 of the second antenna element AE2*a*. Preferably, the polarization directions of the group of polarization directions PD1, PD5, the polarization directions of the group of polarization directions PD2, PD4 and the polarization directions of the group of polarization directions PD3, PD6 are orthogonal to each other.

The third antenna element AE3 is shown as a patch antenna with a ground plate G3 such as a quadratic ground plate and a conductive patch with a quadratic form (see FIG. 4) or a hexagonal form providing the third excitation area EA3. Alternatively, the antenna elements AE1, AE2*a*, AE3 of the antenna array AA4 may be realized by other types than a patch antenna as described with respect to the embodiment of FIG. 1 *a*).

According to a first alternative, the conductive patches of the antenna elements AE1, AE2*a*, AE3 are electrically isolated against each other. Regarding a second alternative, two of the conductive patches of the antenna elements AE1, AE2*a*, AE3 may form a single patch, which is turned around a corner given by one of the axes of the Cartesian coordinate system. In such a case, the patch may have a form of a rectangular metal edge profile and only two of the four polarization directions are independent from each other. The second alternative provides the advantage of requiring less control signals and less feeder cables, which makes a composition of the antenna element less complex and may reduce costs.

Similar alternatives as described with respect to the embodiment of FIG. 1 *a*) may be applied for non-orthogonal polarization directions of the antenna elements AE1, AE2*a*, AE3 of the antenna array AA4.

In alternative embodiments not shown in FIG. 4, the second antenna element AE2*a* and/or the third antenna element AE3 may be replaced by antenna elements similar to the second antenna element AE2*b* of the antenna array AA2 with a single polarization direction and at least one of the replaced antenna elements provide a polarization direction in the z direction.

When the excitation areas AE1, AE2*a* and AE3 are vertical to each other as shown in FIG. 4, an outer form of the antenna elements is preferably quadratic. When in an alternative embodiment the excitation areas AE1, AE2*a* and AE3 are not vertical to each other, an outer form of the antenna elements may be for example rhombic or a mixture of pentagonal and hexagonal surface elements similar to surface elements of a football.

The antenna array AA4 may be preferably applied, when there is a large angular spread in all three dimensions.

The centers of the antenna elements AE1, AE2*a* and AE3 as shown in FIG. 4 are at following positions:

$$r_1 = \frac{D}{2}\begin{pmatrix}1\\1\\0\end{pmatrix},\quad r_2 = \frac{D}{2}\begin{pmatrix}0\\1\\1\end{pmatrix},\quad r_3 = \frac{D}{2}\begin{pmatrix}1\\0\\1\end{pmatrix} \tag{15}$$

An incoming electromagnetic wave traveling in direction of a wave vector k can be described by an electric field vector $E(r,t)=E\exp[-j(\omega t-k\cdot r)]$ with $E\cdot k=0$, i.e., the electric field vector is orthogonal to the wave vector $k=(k_x, k_y, k_z)^T$, as following electric field vectors at the centers of the antenna elements AE1, AE2*a*, AE3:

$$E_1 = E(r_1, t) = E\ \exp\left[-j\left(\omega t - \frac{D}{2}(k_x + k_y)\right)\right] \tag{16}$$

$$E_2 = E(r_2, t) = E\ \exp\left[-j\left(\omega t - \frac{D}{2}(k_y + k_z)\right)\right] \tag{17}$$

$$E_3 = E(r_3, t) = E\ \exp\left[-j\left(\omega t - \frac{D}{2}(k_x + k_z)\right)\right] \tag{18}$$

The first antenna element AE1 receives an x component $E_{1,x}$ and an y component $E_{1,y}$ of the incoming electromagnetic wave according to following equations: $E_{1,x}=E_1\cdot e_x$, $E_{1,y}=E_1\cdot e_x$.

A received signal $r_{1,x}$ of the x component $E_{1,x}$ at the first antenna element AE1 may be represented by equation $$r_{1,x}=E_{1,x}\cdot f_{1,x}(k), \tag{19}$$

where $f_{1,x}(k)$ is a function of the wave vector k and describes a strength of an output signal of the first antenna element AE1 in dependence of direction of propagation of the incoming electromagnetic wave.

Accordingly, a received signal $r_{1,y}$ of the y component $E_{1,y}$ at the first antenna element AE1, a received signal $r_{2,y}$ of a y component $E_{2,y}$ at the second antenna element AE2*a*, a received signal $r_{2,z}$ of a z component $E_{2,z}$ at the second antenna element AE2, a received signal $r_{3,z}$ of a z component $E_{3,z}$ at the third antenna element AE3 and a received signal $r_{3,x}$ of an x component $E_{3,x}$ at the third antenna element AE3 may be represented by following equations:

$$r_{1,y}=E(r_1,t)\cdot e_y f_{1,y}(k) \tag{20}$$

$$r_{2,y}=E(r_2,t)\cdot e_y f_{2,y}(k),\ r_{2,z}=E(r_2,t)\cdot e_z f_{2,z}(k) \tag{21}$$

$$r_{3,z}=E(r_3,t)\cdot e_z f_{3,z}(k),\ r_{3,x}E(r_3,t)\cdot e_x f_{3,x}(k) \tag{22}$$

The above equations (20), (21) and (22) describe relations between parameters of the incoming electromagnetic wave and the received signals at the different outputs of the antenna elements AE1, AE2*a*, AE3 of the antenna array AA4. Conversely, by feeding antenna ports of the antenna elements AE1, AE2*a*, AE3 of the antenna array AA4 with corresponding signals the antenna array AA4 allows transmitting beams to arbitrary directions in an octant of the three-dimensional space, which behave in significant distance from the antenna array AA4 approximately like plane waves.

When the incoming electromagnetic wave travels in direction of a wave vector $$k_c = \frac{2\pi}{\lambda}\left(-\frac{1}{\sqrt{3}}, -\frac{1}{\sqrt{3}}, -\frac{1}{\sqrt{3}}\right)^T,$$

the electric field vectors at the centers of the excitation areas EA1, EA2*a*, EA3 of the antenna elements AE1, AE2*a*, AE3 are identical:

$$E(r_1, t) = E(r_2, t) = E(r_3, t) = E\ \exp\left[-j\left(\omega t + \frac{2\pi}{\sqrt{3}}\frac{D}{\lambda}\right)\right]. \tag{23}$$

Conversely, if the antenna elements AE1, AE2*a*, AE3 are fed with identical radio frequency signals, an outgoing electromagnetic wave with maximum amplitude in an opposite propagation direction with a wave vector $-k_c$ is transmitted.

Figure 5:
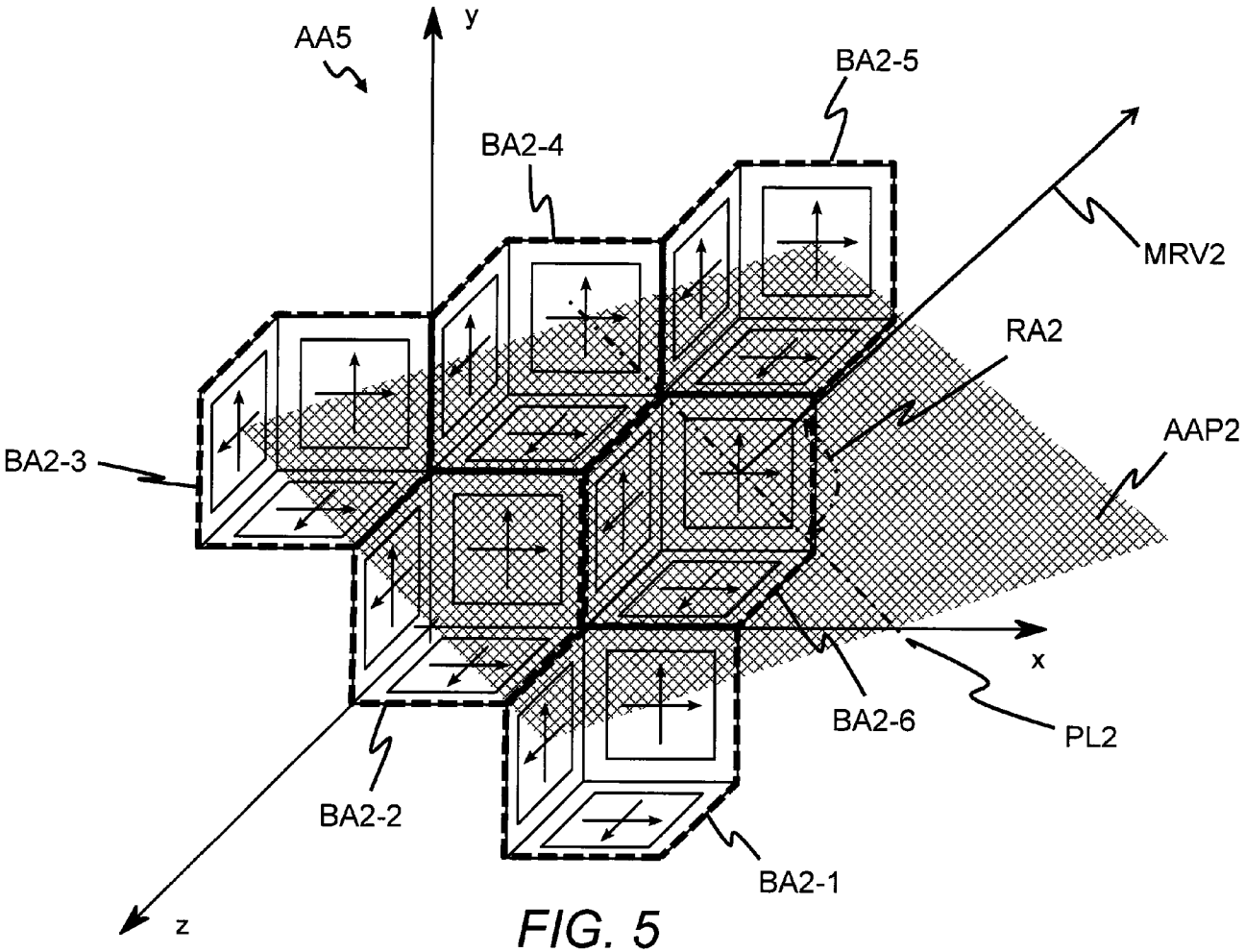
FIG. 5 shows schematically in a perspective view an antenna array based on several second basic arrangements of the antenna array of the fourth embodiment of the invention.

FIG. 5 shows schematically an antenna array AA5 with a number of 18 antenna elements, which is based on the second basic arrangement BA2 or building block of the antenna array AA4 as shown in FIG. 4. Alternatively, the number of antenna elements may be below 18 such as 15 or even less or above 18 such as 24 or even more.

The antenna array AA5 contains a first BA2-1 of the second basic arrangement BA2, a second BA2-2 of the second basic arrangement BA2 adjacent to the first one of the second basic arrangement BA2 and with an offset in −x direction and y-direction both equal to a size of a longitudinal edge of a single antenna element. In a same way, the antenna array AA5 further contains a third BA2-3 of the second basic arrangement BA2 adjacent to the second BA2-2 of the second basic arrangement BA2 and with an offset in −x direction and y-direction both equal to the size of the longitudinal edge of the single antenna element. In a same way, the antenna array AA5 further contains a fourth BA2-4 of the second basic arrangement BA2 adjacent to the third BA2-3 and the second BA2-2 of the second basic arrangement BA2 and with an offset in x direction and −z-direction both equal to the size of the longitudinal edge of the single antenna element with respect to the third BA2-3 of the second basic arrangement BA2. In a same way, the antenna array AA5 further contains a fifth BA2-5 of the second basic arrangement BA2 adjacent to the fourth BA2-4 of the second basic arrangement BA2 and with an offset in x direction and −z-direction both equal to the size of the longitudinal edge of the single antenna element. In a same way, the antenna array AA5 further contains a sixth BA2-6 of the second basic arrangement BA2 adjacent to the fifth BA2-4 and the first BA2-1 of the second basic arrangement BA2 and with an offset in −y direction and z-direction both equal to the size of the longitudinal edge of the single antenna element with respect to the fifth BA2-5 of the second basic arrangement BA2. Thereby, the first BA2-1, the second BA2-2, the third BA2-3, the fourth BA2-4, the fifth BA2-5 and the sixth BA2-6 of the second basic arrangement BA2 are arranged adjacent to each other to form an overall antenna array with, for example, a substantially triangular, rhombohedral or hexagonal form.

All variants and alternatives, which are described with respect to the second basic arrangement BA2 of the antenna array AA3 may be applied for the antenna array AA5.

Centers of all antenna elements of the antenna array AA5 may be within an antenna array plane AAP2 as shown in FIG. 5. A vector MRV2 is orthogonal to the antenna array plane AAP2 with an angle RA2 of 90 angular degrees.

In alternative embodiments, the centers of the antenna elements of the antenna array AA5 may be arranged to form a concave or convex surface or to form a lateral surface of a cylinder or a sphere.

When an incoming electromagnetic wave travels in a propagation direction $k_c$ opposite to the vector MRV2, the electrical fields of received signals at the centers of all antenna elements have a same phase. Conversely, if all antenna elements are excited with the same phase the antenna array AA5 transmits a signal in a propagation direction $-k_c$, which is parallel to the vector MRV2.

Relations between parameters of the incoming electromagnetic wave and the received signals at the different outputs of the elements of the antenna array in FIG. 5 can be described by similar formulas as in the two-dimensional case with respect to FIG. 3. Conversely, beams may be transmitted that (in significant distance from the antenna) behave like approximately plane waves with an arbitrary direction in an octant of the three-dimensional space by feeding the antenna ports with corresponding signals. The width of the transmitted beam depends on the number of antenna elements used and the distance to the antenna array AA5.

Typically, the antenna array AA5 may be mounted in such a way that direction $$-k_c = \frac{2\pi}{\lambda}\left(\frac{1}{\sqrt{3}}, \frac{1}{\sqrt{3}}, \frac{1}{\sqrt{3}}\right)^T$$

points to the main direction of a transmission channel.

Figure 6:
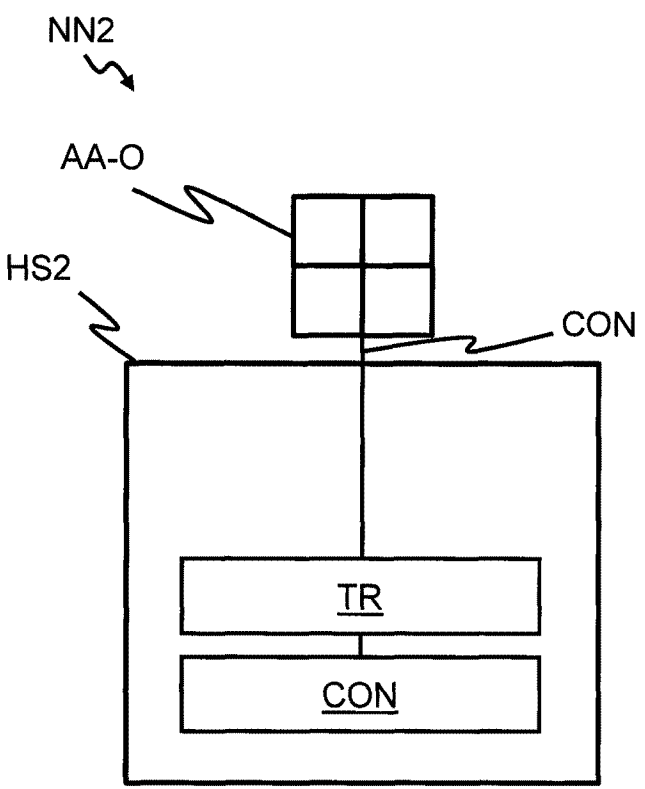
FIG. 6 shows schematically a first block diagram of an access network node comprising an antenna array according to one of the embodiments of the invention and a second block diagram of a further access network node connected to an antenna array according to one of the embodiments of the invention.
Figure 6:
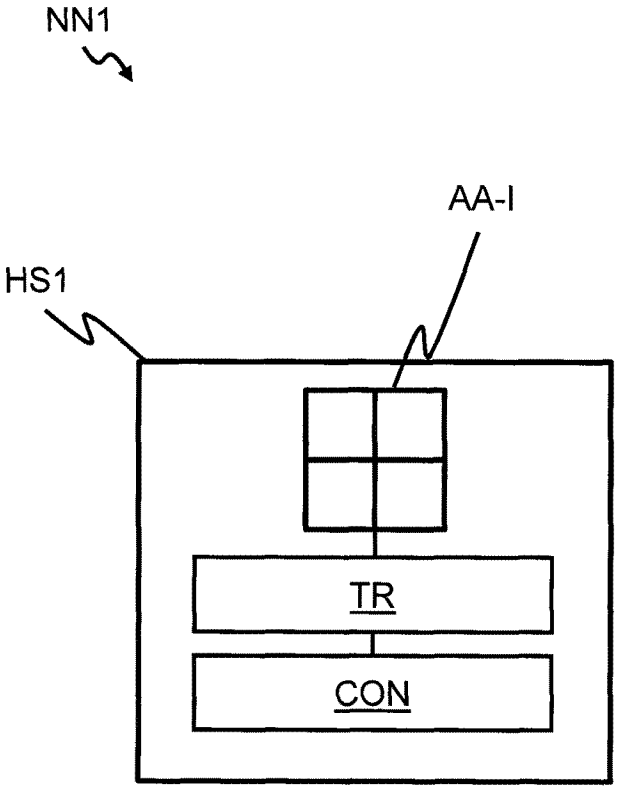

Referring to FIG. 6 *a*) a block diagram of an access network node NN1 is shown. The access network node NN1 contains within a housing or a casting HS1 an antenna array AA, a transceiver TR connected to the antenna array AA-I, and a controller or processor CON connected to the transceiver TR. The term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. The controller CON and parts of the transceiver TR may be part of a so-called baseband board. The antenna array AA-I may be one of the antenna arrays AA1, AA2, AA3, AA4 or AA5 as described above.

FIG. 6 *b*) shows a further block diagram of an access network node NN2, which contains an antenna array AA-O outside the housing or casting HS2 of the access network node NN2. The antenna array AA-O is connected to the transceiver TR of the access network node NN2 by a connection CON, which may be a cable such as a coaxial cable. The antenna array AA-O may be one of the antenna arrays AA1, AA2, AA3, AA4 or AA5 as described above.

The access network nodes NN1 and NN2 may be a base station, a mobile station, a repeater or a relay respectively. The term "base station" may be considered synonymous to and/or referred to as a base transceiver station such as an LTE NodeB (LTE=Long Term Evolution), access point base station, access point, macro-cell, microcell, femto-cell, pico-cell, a WLAN router (WLAN=Wireless Local Area Network) etc. and may describe equipment that provides wireless connectivity via one or more radio links to one or more mobile stations. The term "mobile station" may be considered synonymous to, and may hereafter be occasionally referred to, as a mobile unit, mobile user, access terminal, user equipment, subscriber, user, remote station etc. The mobile station may be for example a cellular telephone, a portable computer, a pocket computer, a hand-held computer, a personal digital assistant or a car-mounted mobile device. The term "repeater" may be considered synonymous to and/or referred to as an electronic device that receives a signal and simply retransmits it at a higher level or higher power, or onto another side of an obstruction, so that the signal can cover longer distances. The term "relay" may be considered synonymous to and/or referred to as an electronic device that receives a signal and retransmits a different signal not only at a higher level or higher power, but also at a different frequency and/or different time slot and/or spreading code, to increase capacity in a wireless access network and to improve wireless link performance.

Figure 7:
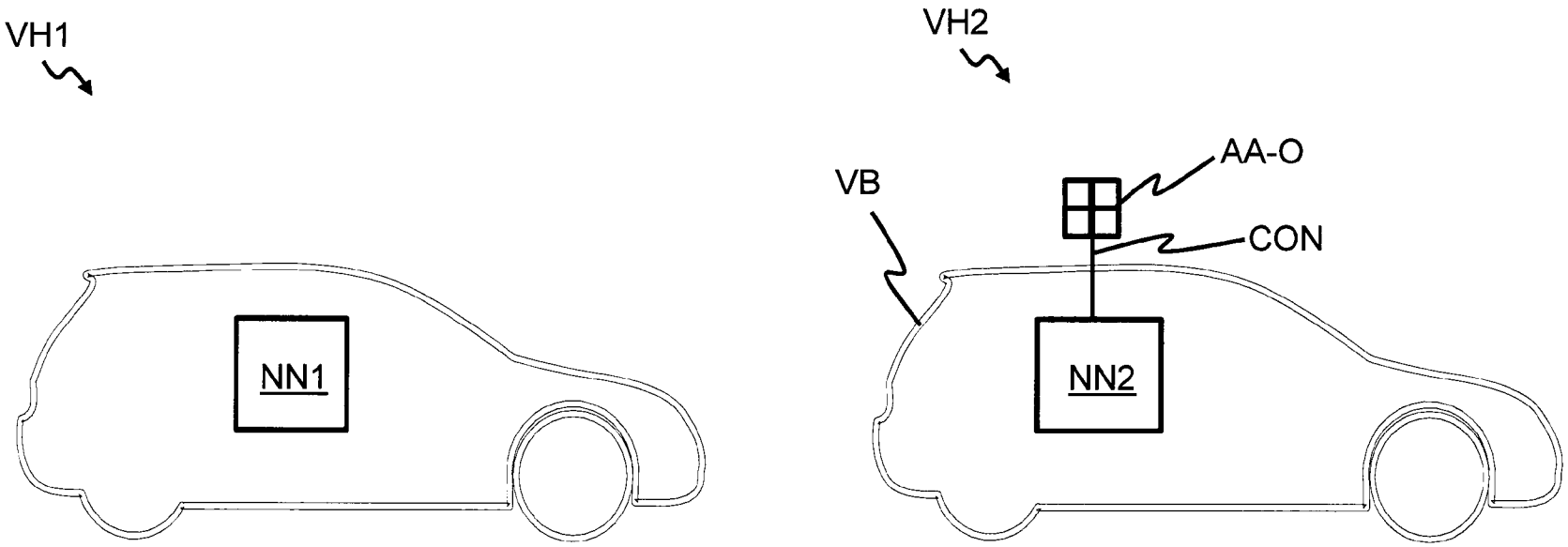
FIG. 7 shows schematically a first block diagram of a vehicle comprising an access network node with an antenna array according to one of the embodiments of the invention and a second block diagram of a further vehicle comprising a further access network, which is connected to an antenna array according to one of the embodiments of the invention.

Referring to FIG. 7 *a*) a block diagram of a vehicle VH1 is shown. The vehicle VH1 contains the access network node NN1 for providing wireless access between vehicle occupants inside the vehicle VH1 and a radio access network such as based on UMTS (UMTS=Universal Mobile Telecommunications System), LTE or LTE Advanced. This means, that the antenna array AA-I of the access network node NN1 is properly located within the vehicle VH1.

FIG. 7 *b* shows a further block diagram of a vehicle VH2 with an alternative arrangement for the antenna array AA-O. The antenna array AA-O is located outside the vehicle body VB and is connected by the connection CON to the access network node NN2, which is located inside the vehicle body VB.

The vehicles VH1 and VH2 are shown as cars. The term "vehicle" may be further considered synonymous to and/or referred to a lorry, a bus, a train, a streetcar or tramway, a ship, a plane etc.

The invention claimed is:

1. An antenna array for transmitting and/or for receiving radio frequency signals, said antenna array comprising a first antenna element and at least one second antenna element forming a basic arrangement, said first antenna element is adapted to excite within a first excitation area a first electromagnetic field with a first polarization direction and a second electromagnetic field with a second polarization direction different to said first polarization direction, said at least one second antenna element is arranged adjacent to said first antenna element and said at least one second antenna element is adapted to excite at least a third electromagnetic field with a third polarization direction non-parallel to said first polarization direction and non-parallel to said second polarization direction within at least one second excitation area arranged non-parallel to said first excitation area and facing towards said first excitation area, wherein said antenna array further comprises at least one further arrangement of said basic arrangement such that the further arrangement similarly includes a first antenna element and at least one second antenna element, said further arrangement being arranged adjacent to said basic arrangement, wherein said first antenna element of said basic arrangement and the first antenna element of said at least one further arrangement constitute a first group of parallel arranged antenna elements, wherein said at least one second antenna element of said basic arrangement and the at least one second antenna element of said at least one further arrangement constitute at least one second group of parallel arranged antenna elements, wherein said first group of parallel arranged antenna elements and said at least one second group of parallel arranged antenna elements are arranged interleaved with one another so that elements in the first group alternate with elements in the second group along an axis given by an intersection line of a first plane spanned by said first excitation area and of a second plane spanned by said second excitation area.

2. Antenna array according to claim 1, wherein said at least one second antenna element is further adapted to excite a fourth electromagnetic field with a fourth polarization direction different to said at least third polarization direction.

3. Antenna array according to claim 1, wherein said first excitation area is arranged orthogonal to said at least one second excitation area.

4. Antenna array according to claim 1, wherein said first polarization direction, said second polarization direction and said third polarization direction are arranged orthogonal to each other.

5. Antenna array according to claim 1, wherein said basic arrangement further comprises a third antenna element, wherein said third antenna element is arranged adjacent to said first antenna element and adjacent to said at least one second antenna element and wherein said third antenna element is adapted to excite at least a fifth electromagnetic field with a fifth polarization direction within a third excitation area arranged non-parallel to said first excitation area and non-parallel to said second excitation area and facing towards said first excitation area and said second excitation area.

6. Antenna array according to claim 5, wherein said first excitation area, said second excitation area and said third excitation area are arranged orthogonally to each other.

7. Antenna array according to claim 5, wherein antenna elements of said antenna array are arranged in a substantially triangular, rhombohedral or hexagonal form.

8. Antenna array according to claim 1, wherein central points of excitation areas of said first antenna element and said at least one second antenna element of the basic arrangement and the first antenna element and said at least one second antenna element of the further arrangement are all arranged in a plane or form a concave or convex surface or form a lateral surface of a cylinder.

9. Antenna array according to claim 1, wherein said antenna elements are patch antennas.

10. An access network node comprising an antenna array according to claim 1.

11. A vehicle comprising an access network node according to claim 10.

12. An antenna array for transmitting and/or for receiving radio frequency signals, said antenna array comprising a first antenna element and at least one second antenna element forming a basic arrangement, said first antenna element is adapted to excite within a first excitation area a first electromagnetic field with a first polarization direction and a second electromagnetic field with a second polarization direction different to said first polarization direction, said at least one second antenna element is arranged adjacent to said first antenna element and said at least one second antenna element is adapted to excite at least a third electromagnetic field with a third polarization direction non-parallel to said first polarization direction and non-parallel to said second polarization direction within at least one second excitation area arranged non-parallel to said first excitation area and facing towards said first excitation area, wherein said antenna array further comprises at least one further arrangement of said basic arrangement such that the further arrangement similarly includes a first antenna element and at least one second antenna element, said further arrangement being arranged adjacent to said basic arrangement, wherein said first antenna element of said basic arrangement and one of the first antenna element and the at least one second antenna element of said at least one further arrangement constitute a first group of parallel arranged antenna elements, wherein said at least one second antenna element of said basic arrangement and the other one of the first antenna element and the at least one second antenna element of said at least one further arrangement constitute at least one second group of parallel arranged antenna elements, wherein said first group of parallel arranged antenna elements and said at least one second group of parallel arranged antenna elements are arranged interleaved in at least one direction across a multiple folded area of excitation areas of antenna elements, wherein said basic arrangement and said further arrangement each further comprise a third antenna element, wherein said third antenna element is arranged adjacent to said first antenna element and adjacent to said at least one second antenna element and wherein said third antenna element is adapted to excite at least a fifth electromagnetic field with a fifth polarization direction within a third excitation area arranged non-parallel to said first excitation area and non-parallel to said second excitation area and facing towards said first excitation area and said second excitation area, and wherein said at least one further arrangement of said basic arrangement is arranged adjacent to said basic arrangement with said third antenna element of said basic arrangement and at least one of the first antenna element, the at least one second antenna element and the third antenna element of said at least one further arrangement being parallel arranged.

* * * * *